US005501823A

United States Patent [19]

Lund et al.

[11] Patent Number: 5,501,823

[45] **Date of Patent: * Mar. 26, 1996**

[54] PREPARATION OF ANHYDROUS TETRAZOLE GAS GENERANT COMPOSITIONS

[75] Inventors: Gary K. Lund, Ogden; Reed J. Blau, Richmond, both of Utah

[73] Assignee: Thiokol Corporation, Ogden, Utah

[ * ] Notice: The portion of the term of this patent subsequent to Jan. 7, 2014, has been disclaimed.

[21] Appl. No.: 162,596

[22] Filed: Dec. 3, 1993

Related U.S. Application Data

[63] Continuation-in-part of Ser. No. 101,396, Aug. 2, 1993.

[51] Int. Cl.[6] ..... C06B 21/00

[52] U.S. Cl. ..... 264/3.1; 149/109.6

[58] Field of Search ..... 149/109.6; 264/3.1

[56] References Cited

U.S. PATENT DOCUMENTS

| | | | |
|---|---|---|---|
| 2,981,616 | 4/1961 | Boyer | 52/5 |
| 3,122,462 | 2/1964 | Kaufman et al. | 149/35 |
| 3,468,730 | 9/1969 | Gawlick et al. | 149/61 |
| 3,674,059 | 7/1972 | Stephenson | 141/4 |
| 3,719,604 | 3/1973 | Prior et al. | 252/186 |
| 3,739,574 | 6/1973 | Godfrey | 60/39.03 |
| 3,773,351 | 11/1973 | Catanzarite | 280/150 AB |
| 3,773,352 | 11/1973 | Radke | 280/150 AB |
| 3,773,947 | 11/1973 | Boyars et al. | 423/351 |
| 3,775,182 | 12/1973 | Marshall | 252/188.3 |
| 3,778,084 | 12/1973 | Sutherland et al. | 280/150 |
| 3,779,823 | 12/1973 | Price et al. | 149/19 |
| 3,785,149 | 1/1974 | Timmerman | 60/205 |
| 3,787,074 | 1/1974 | Lewis et al. | 280/150 AB |
| 3,791,302 | 2/1974 | McLeod | 102/70.2 |
| 3,806,461 | 4/1974 | Hendrickson et al. | 252/188.3 R |
| 3,833,029 | 9/1974 | Munn | 141/4 |
| 3,833,432 | 9/1974 | Moy et al. | 149/19.3 |
| 3,862,866 | 1/1975 | Timmerman et al. | 149/21 |
| 3,868,124 | 2/1975 | Johnson | 280/150 AB |
| 3,880,447 | 4/1975 | Thorn et al. | 280/150 AB |
| 3,880,595 | 4/1975 | Timmerman | 23/281 |
| 3,883,373 | 5/1975 | Sidebottom | 149/6 |
| 3,895,098 | 7/1975 | Pietz | 423/351 |
| 3,897,235 | 7/1975 | Hamilton et al. | 149/41 |
| 3,898,112 | 8/1975 | Strecker et al. | 149/19.9 |
| 3,902,934 | 9/1975 | Timmerman | 149/83 |
| 3,912,458 | 10/1975 | Fukuma et al. | 23/281 |
| 3,912,561 | 10/1975 | Doin et al. | 149/35 |
| 3,912,562 | 10/1975 | Garner | 149/41 |
| 3,931,040 | 1/1976 | Breazcale | 252/188.3 R |
| 3,933,543 | 1/1976 | Madden | 149/21 |
| 3,934,984 | 1/1976 | Marlow et al. | 23/281 |
| 3,936,330 | 2/1976 | Dergazarian et al. | 149/35 |
| 3,947,300 | 3/1976 | Passauer et al. | 149/35 |
| 3,964,255 | 6/1976 | Catanzarite | 60/205 |
| 3,971,729 | 7/1976 | Timmerman | 252/187 R |
| 3,996,079 | 12/1976 | Divalentin | 149/35 |
| 4,021,275 | 5/1977 | Kisahi et al. | 149/35 |
| 4,062,708 | 12/1977 | Goetz | 149/35 |
| 4,114,591 | 9/1978 | Nakagawa | 126/263 |
| 4,128,996 | 12/1978 | Garner et al. | 60/205 |
| 4,142,029 | 2/1979 | Illy | 521/95 |
| 4,152,891 | 5/1979 | Garner | 60/205 |
| 4,157,648 | 6/1979 | Brennan et al. | 60/205 |
| 4,179,327 | 12/1979 | Seldner | 156/667 |
| 4,200,615 | 4/1980 | Hamilton et al. | 422/166 |
| 4,203,786 | 5/1980 | Garner | 149/19.91 |
| 4,203,787 | 5/1980 | Kirchoff et al. | 149/35 |
| 4,214,438 | 7/1980 | Hamilton et al. | 60/205 |
| 4,238,253 | 12/1980 | Garner | 149/19 |
| 4,244,758 | 1/1981 | Garner et al. | 149/7 |
| 4,246,051 | 1/1981 | Garner et al. | 149/7 |
| 4,298,412 | 11/1981 | Biddle et al. | 149/19.5 |
| 4,306,499 | 12/1981 | Holmes | 102/202.4 |
| 4,339,288 | 7/1982 | Camp | 149/8 |
| 4,369,079 | 1/1983 | Shaw | 149/2 |
| 4,370,181 | 1/1983 | Lundstrom et al. | 149/2 |
| 4,370,930 | 2/1983 | Strasser et al. | 102/530 |
| 4,376,002 | 3/1983 | Utracki | 149/35 |
| 4,390,380 | 6/1983 | Camp | 149/8 |
| 4,407,119 | 10/1983 | Biddle et al. | 60/219 |
| 4,414,902 | 11/1983 | Strasser et al. | 102/531 |
| 4,424,086 | 1/1984 | Christopher | 149/19.3 |
| 4,533,416 | 8/1985 | Poole | 149/35 |
| 4,547,235 | 10/1985 | Schneiter et al. | 149/35 |
| 4,547,342 | 10/1985 | Adams et al. | 422/166 |
| 4,578,247 | 3/1986 | Bolieau | 422/165 |
| 4,590,860 | 5/1986 | Kromrey | 102/289 |
| 4,604,151 | 8/1986 | Knowlton et al. | 149/35 |
| 4,608,102 | 8/1986 | Krampen et al. | 149/92 |
| 4,664,033 | 5/1987 | Burkdoll et al. | 102/275.2 |
| 4,696,705 | 9/1987 | Hamilton | 149/21 |
| 4,698,107 | 10/1987 | Goetz et al. | 149/7 |
| 4,699,400 | 10/1987 | Adams et al | 280/731 |
| 4,734,141 | 3/1988 | Cartwright et al. | 149/35 |
| 4,758,287 | 7/1988 | Pietz | 149/2 |
| 4,798,142 | 1/1989 | Canterberry et al. | 102/290 |

(List continued on next page.)

FOREIGN PATENT DOCUMENTS

051985A1 12/1992 European Pat. Off. ..... C06D 5/06

OTHER PUBLICATIONS

William P. Norris and Ronald A. Henry, "Cyanoguanyl Azide Chemistry", pp. 650–660, Mar. 1964.

R. Stollé, "5–Aminotetrazole", 10—*Organic Chemistry*, vol. 23, p. 4471, 1929.

*Primary Examiner*—Edward A. Miller

*Attorney, Agent, or Firm*—Madson & Metcalf; Ronald L. Lyons

[57] ABSTRACT

A solid composition for generating nitrogen containing gas is provided. The composition includes an oxidizer and a non-azide fuel selected from anhydrous tetrazoles, derivatives, salts, complexes, and mixtures thereof. Preferred tetrazoles include 5-aminotetrazole and bis-(1(2)H-tetrazol-5-yl)-amine, a metal salt, a salt with a nonmetallic cation of a high nitrogen content base or a complex thereof. The salts and complexes are generally metal salts and complexes. The metal can be a transition metal. Metals that have been found to be particularly useful include copper, boron, cobalt, zinc, potassium, sodium, and strontium. The oxidizer is generally a metal oxide or a metal hydroxide. The composition can include certain other components such as secondary oxidizers, burn rate modifiers, slag formers, and binders.

22 Claims, 3 Drawing Sheets

U.S. PATENT DOCUMENTS

| | | | |
|---|---|---|---|
| 4,806,180 | 2/1989 | Goetz et al. | 149/5 |
| 4,833,996 | 5/1989 | Hayashi et al. | 102/530 |
| 4,834,817 | 5/1989 | Zeuner et al. | 149/35 |
| 4,834,818 | 5/1989 | Kazumi et al. | 149/35 |
| 4,865,667 | 9/1989 | Zeuner et al. | 149/22 |
| 4,890,860 | 1/1990 | Schneiter | 280/741 |
| 4,909,549 | 3/1990 | Poole et al. | 280/738 |
| 4,919,897 | 4/1990 | Bender et al. | 422/165 |
| 4,931,111 | 6/1990 | Poole et al. | 149/35 |
| 4,931,112 | 6/1990 | Wardle et al. | 149/88 |
| 4,948,439 | 8/1990 | Poole et al. | 149/46 |
| 4,950,458 | 8/1990 | Cunningham | 422/164 |
| 4,959,011 | 9/1990 | Nilsson | 431/263 |
| 4,981,534 | 1/1991 | Scheffe | 149/19.91 |
| 4,982,664 | 1/1991 | Norton | 102/272 |
| 4,998,751 | 3/1991 | Paxton et al. | 280/741 |
| 5,003,887 | 4/1991 | Unterforsthuber | 102/531 |
| 5,004,586 | 4/1991 | Hayashi et al. | 422/164 |
| 5,005,486 | 4/1991 | Lenzen | 102/531 |
| 5,015,311 | 5/1991 | Ramaswamy | 149/42 |
| 5,019,192 | 5/1991 | Ramaswamy | 149/42 |
| 5,019,220 | 5/1991 | Taylor et al. | 264/3.4 |
| 5,022,674 | 6/1991 | Frantom et al. | 280/741 |
| 5,024,160 | 6/1991 | Canterberry et al. | 102/323 |
| 5,031,932 | 7/1991 | Frantom et al. | 280/741 |
| 5,033,390 | 7/1991 | Minert et al. | 102/530 |
| 5,035,757 | 7/1991 | Poole | 149/46 |
| 5,043,030 | 8/1991 | Ramaswamy | 149/16 |
| 5,046,429 | 9/1991 | Swann et al. | 102/530 |
| 5,052,817 | 11/1991 | Bement et al. | 374/8 |
| 5,062,365 | 11/1991 | Canterberry | 102/322 |
| 5,062,367 | 11/1991 | Hayashi et al. | 102/530 |
| 5,073,273 | 12/1991 | Gupta et al. | 210/760 |
| 5,074,940 | 12/1991 | Ochi et al. | 149/35 |
| 5,084,118 | 1/1992 | Poole | 149/22 |
| 5,089,069 | 2/1992 | Ramaswamy et al. | 149/21 |
| 5,094,475 | 3/1992 | Olsson et al. | 280/741 |
| 5,098,597 | 3/1992 | Rothgery et al. | 252/182.34 |
| 5,100,174 | 3/1992 | Jasken et al. | 280/741 |
| 5,104,466 | 4/1992 | Allard et al. | 149/21 |
| 5,139,588 | 8/1992 | Poole | 149/61 |
| 5,197,758 | 3/1993 | Lund et al. | 280/741 |
| 5,212,343 | 5/1993 | Brupbacher et al. | 102/323 |

PREPARATION OF ANHYDROUS TETRAZOLE GAS GENERANT COMPOSITIONS

RELATED APPLICATIONS

The present application is a continuation-in-part of copending application Ser. No. 08/101,396 filed Aug. 2, 1993 and entitled "BITETRAZOLEAMINE GAS GENERANT COMPOSITIONS AND METHODS OF USE," which application is incorporated herein by this reference.

FIELD OF THE INVENTION

The present invention relates to novel gas generating compositions for inflating automobile air bags and similar devices. More particularly, the present invention relates to the use of anhydrous tetrazole compounds as a primary fuel in gas generating pyrotechnic compositions, and to methods of preparation of such compositions.

BACKGROUND OF INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

There are a number of additional important design criteria that must be satisfied. Automobile manufacturers and others set forth the required criteria which must be met in detailed specifications. Preparing gas generating compositions that meet these important design criteria is an extremely difficult task. These specifications require that the gas generating composition produce gas at a required rate. The specifications also place strict limits on the generation of toxic or harmful gases or solids. Examples of restricted gases include carbon monoxide, carbon dioxide, NOx, SOx, and hydrogen sulfide.

The automobile manufacturers have also specified that the gas be generated at a sufficiently and reasonably low temperature so that the occupants of the car are not burned upon impacting an inflated air bag. If the gas produced is overly hot, there is a possibility that the occupant of the motor vehicle may be burned upon impacting a just deployed air bag. Accordingly, it is necessary that the combination of the gas generant and the construction of the air bag isolates automobile occupants from excessive heat. All of this is required while the gas generant maintains an adequate burn rate. In the industry, burn rates in excess of 0.5 inch per second (ips) at 1,000 psi, and preferably in the range of from about 1.0 ips to about 1.2 ips at 1,000 psi are generally desired.

Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device. The latter is one of the undesirable, but tolerated in the absence of an acceptable alternative, aspects of the present sodium azide materials.

In addition to producing limited, if any, quantities of particulates, it is desired that at least the bulk of any such particulates be easily filterable. For instance, it is desirable that the composition produce a filterable, solid slag. If the solid reaction products form a stable material, the solids can be filtered and prevented from escaping into the surrounding environment. This also limits interference with the gas generating apparatus and the spreading of potentially harmful dust in the vicinity of the spent air bag which can cause lung, mucous membrane and eye irritation to vehicle occupants and rescuers.

Both organic and inorganic materials have also been proposed as possible gas generants. Such gas generant compositions include oxidizers and fuels which react at sufficiently high rates to produce large quantities of gas in a fraction of a second.

At present, sodium azide is the most widely used and accepted gas generating material. Sodium azide nominally meets industry specifications and guidelines. Nevertheless, sodium azide presents a number of persistent problems. Sodium azide is relatively toxic as a starting material, since its toxicity level as measured by oral rat $LD_{50}$ is in the range of 45 mg/kg. Workers who regularly handle sodium azide have experienced various health problems such as severe headaches, shortness of breath, convulsions, and other symptoms.

In addition, sodium azide combustion products can also be toxic since molybdenum disulfide and sulfur are presently the preferred oxidizers for use with sodium azide. The reaction of these materials produces toxic hydrogen sulfide gas, corrosive sodium oxide, sodium sulfide, and sodium hydroxide powder. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags, in demolished cars. The sodium azide remaining in such supplemental restraint systems can leach out of the demolished car to become a water pollutant or toxic waste. Indeed, some have expressed concern that sodium azide, when contacted with battery acids following disposal, forms explosive heavy metal azides or hydrazoic acid.

Sodium azide-based gas generants are most commonly used for air bag inflation, but with the significant disadvantages of such compositions many alternative gas generant compositions have been proposed to replace sodium azide. Most of the proposed sodium azide replacements, however, fail to deal adequately with each of the selection criteria set forth above.

One group of chemicals that has received attention as a possible replacement for sodium azide includes tetrazoles and triazoles. These materials are generally coupled with conventional oxidizers such as $KNO_3$ and $Sr(NO_3)_2$. Some of the tetrazoles and triazoles that have been specifically mentioned include 5-aminotetrazole, 3-amino-1,2,4-triazole, 1,2,4-triazole, 1H-tetrazole, bitetrazole and several others. However, because of poor ballistic properties and high gas temperatures, none of these materials has yet gained general acceptance as a sodium azide replacement.

It will be appreciated, therefore, that there are a number of important criteria for selecting gas generating compositions for use in automobile supplemental restraint systems. For example, it is important to select starting materials that are not toxic. At the same time, the combustion products must not be toxic or harmful. In this regard, industry standards limit the allowable amounts of various gases produced by the operation of supplemental restraint systems.

It would, therefore, be a significant advancement in the art to provide compositions capable of generating large quantities of gas that would overcome the problems identified in the existing art. It would be a further advancement to provide gas generating compositions which are based on substantially nontoxic starting materials and which produce substantially nontoxic reaction products. It would be another advancement in the art to provide gas generating compositions which produce limited particulate debris and limited undesirable gaseous products. It would also be an advancement in the art to provide gas generating compositions which form a readily filterable solid slag upon reaction.

Such compositions and methods for their use are disclosed and claimed herein.

SUMMARY AND OBJECTS OF THE INVENTION

The novel solid compositions of the present invention include a non-azide fuel and an appropriate oxidizer. Specifically, the present invention is based upon the discovery that improved gas generant compositions are obtained using anhydrous tetrazoles, such as 5-aminotetrazole and bitetrazoleamines, or a salt or a complex thereof as a non-azide fuel. One presently preferred bitetrazoleamine is bis-(1(2)H-tetrazol-5-yl)-amine (hereinafter sometimes referred to as "BTA"), which has been found to be particularly suitable for use in the gas generating composition of the present invention. In particular, the compositions of the present invention are useful in supplemental restraint systems, such as automobile air bags.

It will be appreciated that tetrazoles of this type generally take the monohydrate form. However, gas generating compositions based upon hydrated tetrazoles have been observed to have unacceptably low burning rates.

The methods of the present invention teach manufacturing techniques whereby the processing problems encountered in the past can be minimized. In particular, the present invention relates to methods for preparing acceptable gas generating compositions using anhydrous tetrazoles. In one embodiment, the method entails the following steps:

a) obtaining a desired quantity of gas generating material, said gas generating material comprising an oxidizer and a hydrated fuel, said fuel selected from the group consisting of tetrazoles;

b) preparing a slurry of said gas generating material in water;

c) drying said slurried material to a constant weight;

d) pressing said material into pellets in hydrated form; and e) drying said pellets such that the gas generating material is in anhydrous form.

Importantly, the methods of the present invention provide for pressing of the material while still in the hydrated form. Thus, it is possible to prepare acceptable gas generant pellets. If the material is pressed while in the anhydrous form, the pellets are generally observed to powder and crumble, particularly when exposed to a humid environment. Following pressing of the pellets, the gas generating material is dried until the tetrazole is substantially anhydrous. Generally, the tetrazole containing composition loses about 3% to 5% of its weight during the drying process. This is found to occur, for example, after drying at 110° C. for 12 hours. A material in this state can be said to be anhydrous for purposes of this application. Of course the precise temperature and length of time of drying is not critical to the practice of the invention, but it is presently preferred that the temperature not exceed 150° C.

Pellets prepared by this method are observed to be robust and maintain their structural integrity when exposed to humid environments. In general, pellets prepared by the preferred method exhibit crush strengths in excess of 10 lb load in a typical configuration (⅜ inch diameter by 0.07 inches thick). This compares favorably to those obtained with commercial sodium azide generant pellets of the same dimensions, which typically yield crush strengths of 5 lb to 15 lb load.

The present compositions are capable of generating large quantities of gas while overcoming various problems associated with conventional gas generating compositions. The compositions of the present invention produce substantially nontoxic reaction products. The present compositions are particularly useful for generating large quantities of a nontoxic gas, such as nitrogen gas. Significantly, the present compositions avoid the use of azides, produce no sodium hydroxide by-products, generate no sulfur compounds such as hydrogen sulfide and sulfur oxides, and still produce a nitrogen containing gas.

The compositions of the present invention also produce only limited particulate debris, provide good slag formation and substantially avoid, if not avoid, the formation of non-filterable particulate debris. At the same time, the compositions of the present invention achieve a relatively high burn rate, while producing a reasonably low temperature gas. Thus, the gas produced by the present invention is readily adaptable for use in deploying supplemental restraint systems, such as automobile air bags.

DETAILED DESCRIPTION OF THE INVENTION

Figure 1:
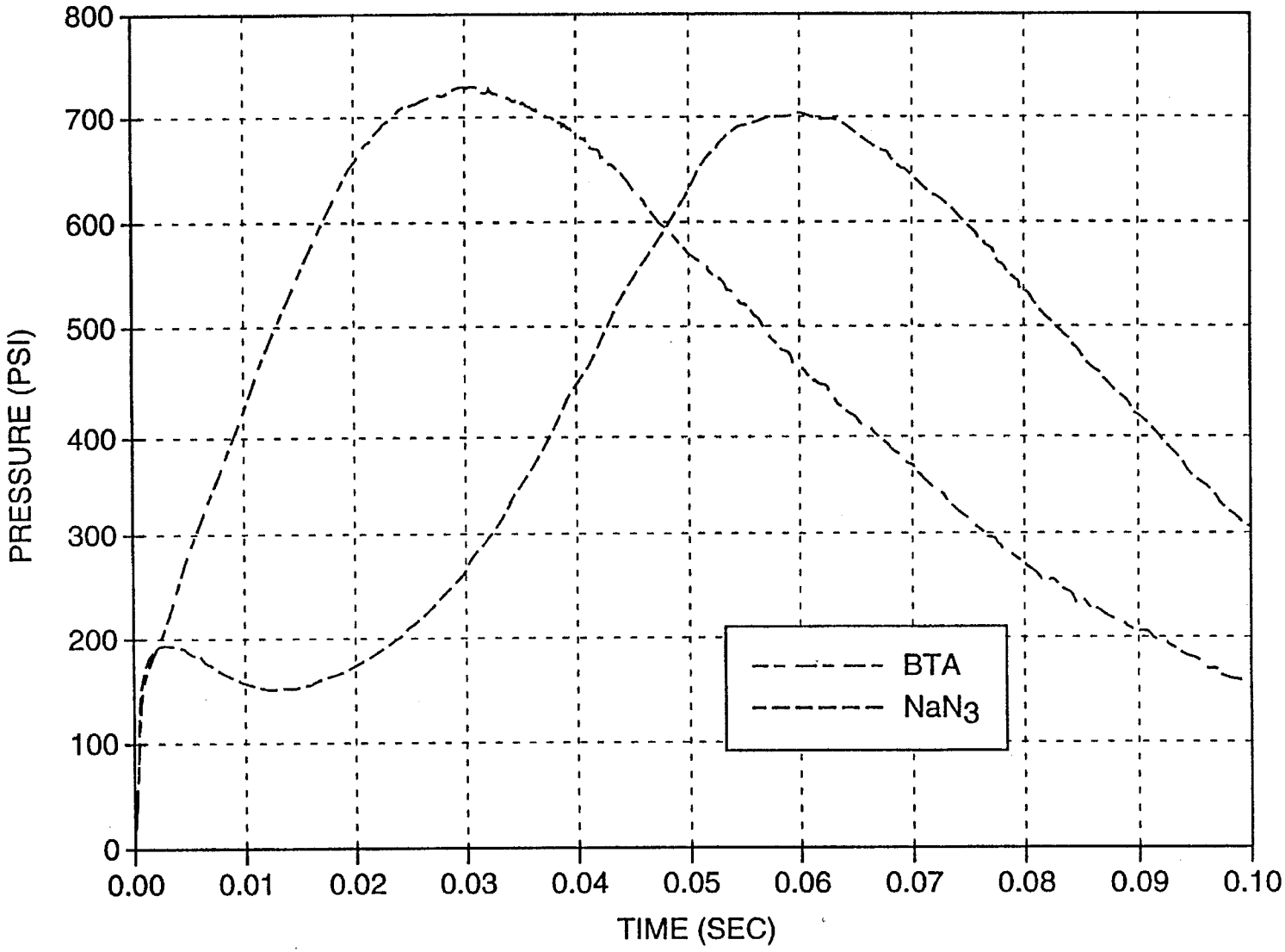
FIG. 1 is a graph illustrating the change in pressure over time within a combustion chamber during the reaction of compositions within the scope of the invention and a conventional sodium azide composition.

The present invention relates to the use of an anhydrous tetrazole, or a salt or a complex thereof, as the primary fuel in a novel gas generating composition.

One group of tetrazoles that fall within the scope of the present invention are bitetrazole-amines such as those having the following structure:

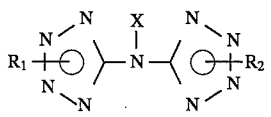

wherein X, $R_1$ and $R_2$, each independently, represent hydrogen, methyl, ethyl, cyano, nitro, amino, tetrazolyl, a metal from Group Ia, Ib, IIa, IIb, IIIa, IVb, VIb, VIIb or VIII of the Periodic Table (Merck Index (11th Edition 1989)), or a nonmetallic cation of a high nitrogen-content base.

Other tetrazoles within the scope of the present invention include tetrazole, 5-aminotetrazole (hereinafter sometimes referred to as "5AT"), bitetrazole, the n-substituted derivatives of aminotetrazole such as nitro, cyano, guanyl, and the like, and c-substituted tetrazoles such as cyano, nitro, hydrazino, and the like.

The present invention also includes salts or complexes of any of these tetrazoles including those of transition metals such as copper, cobalt, iron, titanium, and zinc; alkali metals such as potassium and sodium; alkaline earth metals such as strontium, magnesium, and calcium; boron; aluminum; and nonmetallic cations such as ammonium, hydroxylammonium, hydrazinium, guanidinium, aminoguanidinium, diaminoguanidinium, triaminoguanidinium, or biguanidinium.

In the compositions of the present invention, the fuel is paired with an appropriate oxidizer. Inorganic oxidizing agents are preferred because they produce a lower flame temperature and an improved filterable slag. Such oxidizers include metal oxides and metal hydroxides. Other oxidizers include a metal nitrate, a metal nitrite, a metal chlorate, a metal perchlorate, a metal peroxide, ammonium nitrate, ammonium perchlorate and the like. The use of metal oxides or hydroxides as oxidizers is particularly useful and such materials include for instance, the oxides and hydroxides of copper, cobalt, manganese, tungsten, bismuth, molybdenum, and iron, such as CuO, $Co_2O_3$, $Fe_2O_3$, $MoO_3$, $Bi_2MoO_6$, $Bi_2O_3$, and $Cu(OH)_2$. The oxide and hydroxide oxidizing agents mentioned above can, if desired, be combined with other conventional oxidizers such as $Sr(NO_3)_2$, $NH_4ClO_4$, and $KNO_3$, for a particular application, such as, for instance, to provide increased flame temperature or to modify the gas product yields.

A tetrazole, such as 5AT or BTA, alone or in combination with a salt, complex or derivative thereof in accordance with the formula hereinabove can comprise the fuel in a gas generant composition according to the present invention. The tetrazole fuel is combined, in a fuel-effective amount, with an appropriate oxidizing agent to obtain a gas generating composition. In a typical formulation, the tetrazole fuel comprises from about 10 to about 50 weight percent of the composition and the oxidizer comprises from about 50 to about 90 weight percent thereof. More particularly, a composition can comprise from about 15 to about 35 weight percent fuel and from about 60 to about 85 weight percent oxidizer.

An example of the reaction between the anhydrous tetrazole and the oxidizer is as follows:

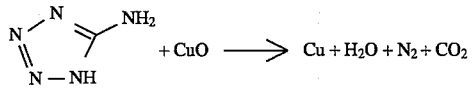

The present compositions can also include additives conventionally used in gas generating compositions, propellants, and explosives, such as binders, burn rate modifiers, slag formers, release agents, and additives which effectively remove $NO_x$. Typical binders include lactose, boric acid, silicates including magnesium silicate, polypropylene carbonate, polyethylene glycol, and other conventional polymeric binders. Typical burn rate modifiers include $Fe_2O_3$, $K_2B_{12}H_{12}$, $Bi_2MoO_6$, and graphite carbon fibers. A number of slag forming agents are known and include, for example, clays, talcs, silicon oxides, alkaline earth oxides, hydroxides, oxalates, of which magnesium carbonate, and magnesium hydroxide are exemplary. A number of additives and/or agents are also known to reduce or eliminate the oxides of nitrogen from the combustion products of a gas generant composition, including alkali metal salts and complexes of tetrazoles, aminotetrazoles, triazoles and related nitrogen heterocycles of which potassium aminotetrazole, sodium carbonate and potassium carbonate are exemplary. The composition can also include materials which facilitate the release of the composition from a mold such as graphite, molybdenum sulfide, calcium stearate, or boron nitride.

Tetrazoles within the scope of the present invention are commercially available or can be readily synthesized. With regard to synthesis of BTA, specific reference is made to application Ser. No. 08/101,396, referred to above.

Substituted tetrazole derivatives, such as substituted 5AT and BTA derivatives, can be prepared from suitable starting materials, such as substituted tetrazoles, according to techniques available to those skilled in the art. For instance, derivatives containing lower alkyl, such as methyl or ethyl, cyano, or tetrazolyl can be prepared by adapting the procedures described in *Journal of Organic Chemistry,* 29:650 (1964), the disclosure of which is incorporated by reference. Amino-containing derivatives can be prepared by adapting the procedures described in *Canadian Journal of Chemistry,* 47:3677 (1969), the disclosure of which is incorporated herein by reference. Nitro-containing derivatives can be prepared by adapting the procedures described in *Journal of the American Chemical Society,* 73:2327 (1951), the disclosure of which is incorporated herein by reference. Other radical-containing derivatives such as those containing ammonium, hydroxylammonium, hydrazinium, guanidinium, aminoguanidinium, diaminoguanidinium, triaminoguanidinium or biguanidinium radicals, can be prepared by adapting the procedures detailed in Boyer, *Nitroazoles, Organic Nitro Chemistry* (1986), the disclosure of which is incorporated by reference.

The present compositions produce stable pellets. This is important because gas generants in pellet form are generally used for placement in gas generating devices, such as automobile supplemental restraint systems. Gas generant pellets should have sufficient crush strength to maintain their shape and configuration during normal use and withstand loads produced upon ignition since pellet failure results in uncontrollable internal ballistics.

As mentioned above, the present invention relates specifically to the preparation of anhydrous gas generant compositions. Anhydrous tetrazole compositions produce advantages over the hydrated forms. For example, a higher (more acceptable) burn rate is generally observed. At the same time, the methods of the present invention allow for pressing the composition in the hydrated form such that pellets with good integrity are produced.

As discussed above, the gas generating composition comprises a tetrazole fuel and an acceptable oxidizer. At the stage of formulating the composition, the tetrazole is in the hydrated form, generally existing as a monohydrate.

A water slurry of the gas generant composition is then prepared. Generally the slurry comprises from about 3% to about 40% water by weight, with the remainder of the slurry comprising the gas generating composition. The slurry will generally have a paste-like consistency, although under some circumstances a damp powder consistency is desirable.

The mixture is then dried to a constant weight. This preferably takes place at a temperature less than about 110° C., and preferably less than about 45° C. The tetrazole will generally establish an equilibrium moisture content in the range of from about 3% to about 5%, with the tetrazole being in the hydrated form (typically monohydrated).

Next, the material is pressed into pellet form in order to meet the requirements of the specific intended end use. As mentioned above, pressing the pellets while the tetrazole material is hydrated results in a better pellet. In particular, crumbling of the material after pressing and upon exposure to ambient humidities is substantially avoided. It will be appreciated that if the pellet crumbles it generally will not burn in the manner required by automobile air bag systems.

After pressing the pellet, the material is dried such that the tetrazole become anhydrous. As mentioned above, typical tetrazole materials lose between 3% and 5% by weight water during this transition to the anhydrous state. It is found to be acceptable if the material is dried for a period of about 12 hours at about 110° C., or until the weight of the material stabilizes as indicated by no further weight loss at the drying temperature. For the purposes of this application, the material in this condition will be defined as "anhydrous."

Following drying it may be preferable to protect the material from exposure to moisture, even though the material in this form has not been found to be unduly hygroscopic at humidities below 20% Rh at room temperature. Thus, the pellet may be placed within a sealed container, or coated with a water impermeable material.

One of the important advantages of the anhydrous tetrazole gas generating compositions of the present invention, is that they are stable and combust to produce sufficient volumes of substantially nontoxic gas products. Tetrazoles have also been found to be safe materials when subjected to conventional impact, friction, electrostatic discharge, and thermal tests.

These anhydrous tetrazole compositions also are prone to form slag, rather than particulate debris. This is a further significant advantage in the context of gas generants for automobile air bags.

An additional advantage of an anhydrous tetrazole-fueled gas generant composition is that the burn rate performance is good. As mentioned above, burn rates above 0.5 inch per second (ips) are preferred. Ideally, burn rates are in the range of from about 1.0 ips to about 1.2 ips at 1,000 psi. Burn rates in these ranges are achievable using the compositions and methods of the present invention.

Anhydrous 5AT and BTA-containing compositions of the present invention compare favorably with sodium azide compositions in terms of burn rate as illustrated in Table 1.

TABLE I

| Gas Generant | Burn Rate at 1000 psi | Relative Vol. Gas Per Vol. Generant |
|---|---|---|
| Sodium azide baseline | 1.2 ± 0.1 psi | 0.97 |
| Sodium azide low sulfur | 1.3 ± 0.2 psi | 1.0 |
| Anhydrous BTA/CuO | 1.2 ± 0.2 psi | 1.1 |
| Anhydrous 5-AT/CuO | 0.75 ± 0.05 psi | 1.2 |

An inflatable restraining device, such as an automobile air bag system comprises a collapsed, inflatable air bag, a means for generating gas connected to that air bag for inflating the air bag wherein the gas generating means contains a nontoxic gas generating composition which comprises a fuel and an oxidizer therefor wherein the fuel comprises an anhydrous tetrazole or a salt or complex thereof, such as 5AT or BTA.

Suitable means for generating gas include gas generating devices which are used is supplemental safety restraint systems used in the automotive industry. The supplemental safety restraint system may, if desired, include conventional screen packs to remove particulates, if any, formed while the gas generant is combusted.

The present invention is further described in the following nonlimiting examples.

EXAMPLES

EXAMPLE 1

A gas generating composition containing bis-(1(2)H-tetrazol-5-yl)-amine and copper oxide was prepared as follows. Cupric oxide powder (92.58 g, 77.16%) and bis-(1(2)H-tetrazol-5-yl)-amine (27.41 g, 22.84%) were slurried in 70 ml of water to form a thin paste. The resulting paste was then dried in vacuo (1 mm Hg) at 130° F. to 170° F. for 24 hours and pressed into pellets. The pellets were tested for burning rate, density, and mechanical crush strength. Burning rate was found to be 1.08 ips at 1,000 psi and the crush strength was found to be 85 pounds load at failure. The density of the composition was determined to be 3.13 g/cc.

EXAMPLE 2

A gas generating composition containing bis-(1(2)H-tetrazol-5-yl)-amine, copper oxide, and water was prepared as follows. Cupric oxide powder (77.15 g, 77.15%) and bis-(1(2)H-tetrazol-5-yl)-amine (22.85 g, 22.85%) were slurried in 55 ml water to form a thin paste. The paste was dried in vacuo (1 mm Hg) at 150° F. to 170° F. until the moisture decreased to 25% of the total generant weight. The moist generant was forced through a 24 mesh screen and the resulting granules were dried at 150° F. to 170° F. for 24 hours. The dried material was exposed to 100% relative humidity ("RH") at 170° F. for 24 hours during which time 2.9% by weight of water was absorbed. The resulting composition was pressed into pellets, and the burning rate, mechanical crush strength, and density were determined. The burning rate was found to be 0.706 ips at 1,000 psi, the mechanical crush strength was found to be 137 pounds load at failure and the density was 3.107 g/cc.

EXAMPLE 3

A BTA-containing composition having a CuO oxidizer prepared according the process of Example 1 was tested by combusting a multiple pellet charge in a ballistic test device. The test device comprised a combustion chamber equipped with a conventional 0.25 gram $BKNO_3$ igniter. The combustion chamber included a fluid outlet to a 13 liter tank. The test fixture was configured such that the environment of an automobile air bag was approximated.

After ignition and burning, a solid combustion residue was produced which remained as a solid mass. The residue retained the general shape of the original pellets. Both the weight and the appearance of the combustion slag pellets were consistent with calculated combustion products predicted to be principally copper metal and copper(I) oxide. Analysis of the gaseous products was further consistent with that predicted by calculational models and were primarily nitrogen, carbon dioxide and water.

Figure 2:
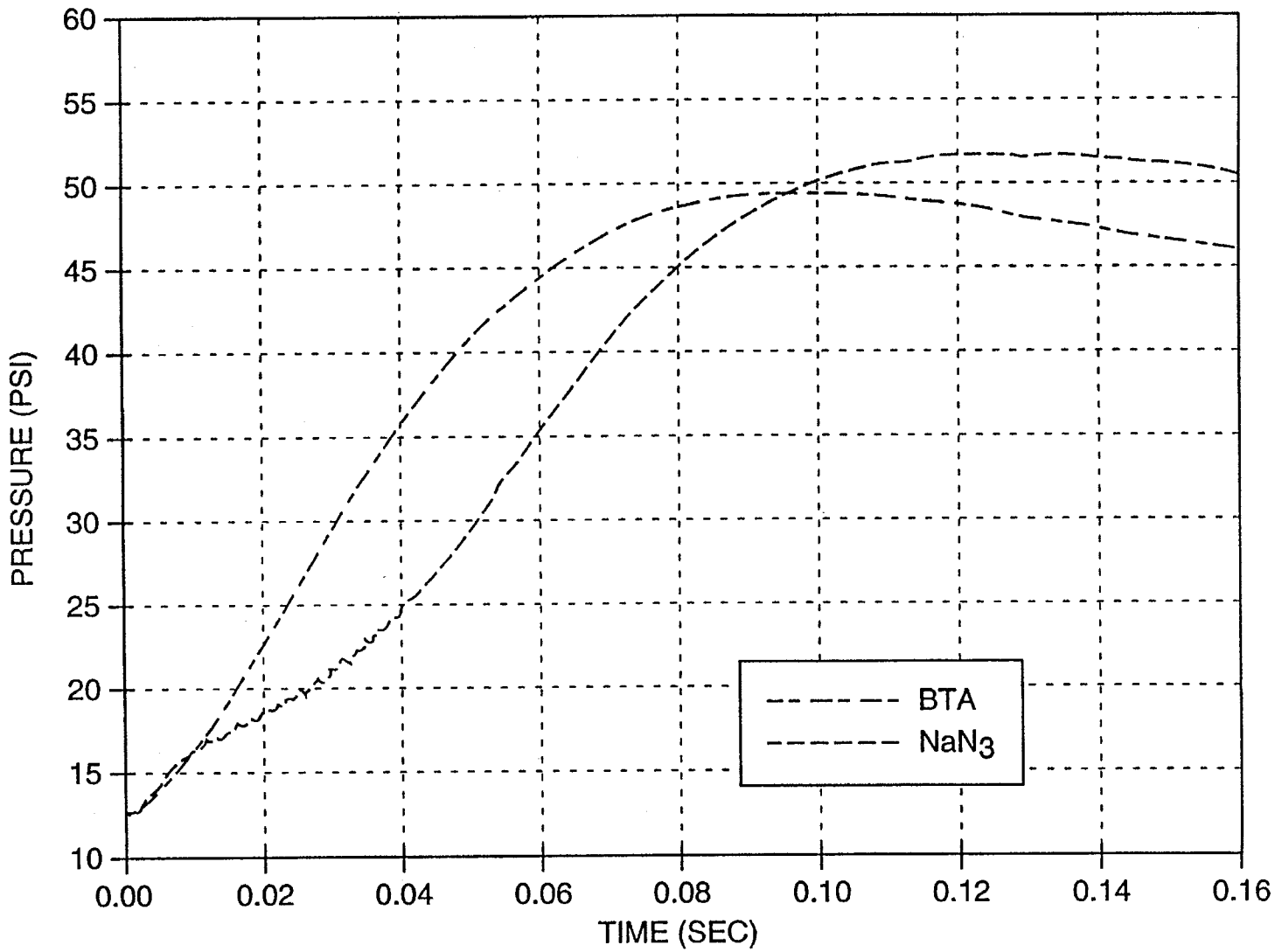
FIG. 2 is a graph illustrating the change in pressure over time within a 13 liter tank during the reaction of compositions within the scope of the invention and a conventional sodium azide composition.
Figure 3:
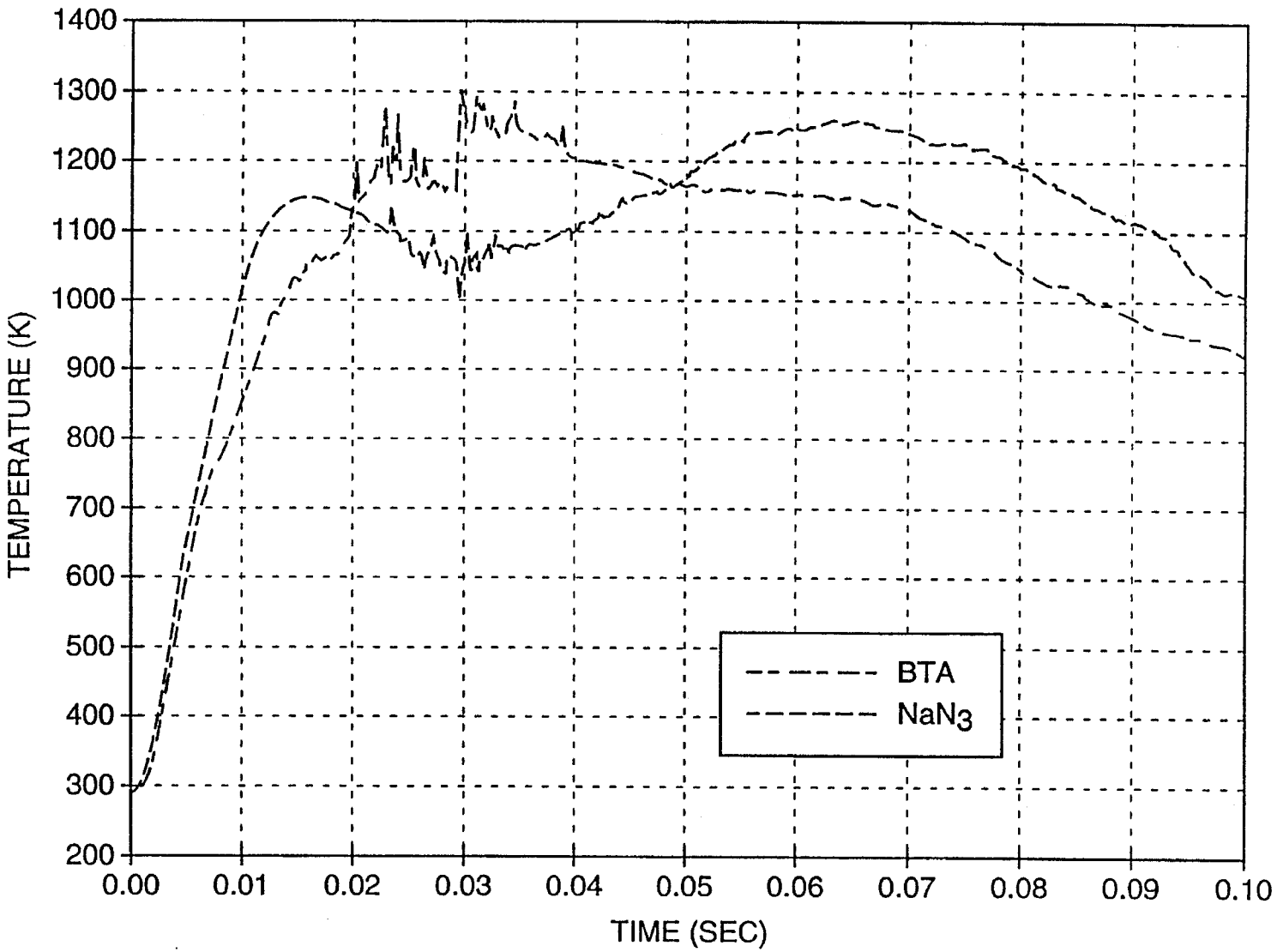
FIG. 3 is a graph illustrating the change in temperature over time for the reaction of compositions within the scope of the invention and conventional sodium azide composition.

The ballistic performance of the BTA/CuO (22.8% BTA/77.2% CuO) gas generant compares favorably to that of a conventional state-of-the-art (baseline) sodium azide gas generant (68% $NAN_3$/2% S/30% $MoS_2$). In comparison, the respective amounts of the BTA/CuO and the sodium azide compositions were selected to generate comparable volumes of gas products. FIGS. 1 through 3 graphically present the data obtained from these tests. FIG. 1 is a plot of the pressure achieved within the combustion chamber versus time. It can be seen that the present BTA-containing composition approximates the maximum pressure achieved by the conventional sodium azide composition, and reaches that pressure in a shorter period of time. As illustrated in FIG. 1 peak pressure is reached in 0.03–0.04 seconds.

FIG. 2 is a plot of pressure versus time in the tank during the reaction. This measurement is designed to predict the pressure curve which would be experienced in the actual air bag. Again, the BTA-containing composition closely approximates the performance of the conventional sodium azide composition.

FIG. 3 is a plot of temperature versus time. Once again, the present BTA-containing composition is comparable to the conventional sodium azide compositions.

EXAMPLE 4

A composition prepared by the process described in Example 2 and containing 2.4% moisture was tested to determine its performance in inflating a standard 60-liter automotive air bag. This performance was compared to that of a conventional sodium azide gas generant composition in inflating a standard 60-liter automotive air bag. The results are set forth in Table II below:

TABLE II

| Composition | Weight of Charge (grams) | Time to Bag Inflation (msec) | Bag External Temperature (°F.) |
|---|---|---|---|
| Baseline $NaN_3$ | 47 | 45 | 166 |
| BTA/CuO | 85 | 70 | 130 |

As shown in Table II, the desired acceptable inflation of the air bag was achieved with the BTA generant. The BTA-containing composition also produced lower temperatures on the bag surface than the sodium azide composition. Less fume and particulate materials were observed with the BTA-containing composition than with the sodium azide composition. With the BTA composition the solid residues and particulates were principally copper metal. With the sodium azide composition, the particulates were principally sodium hydroxide and sodium sulfide, both of which are corrosive and objectionable due to smell and skin irritation.

EXAMPLE 5

Bis-(1(2)H-tetrazol-5-yl)-amine was prepared as follows. Sodium dicyanamide (18 g, 0.2 mole) was dissolved in water along with 27.3 g (0.42 mole) sodium azide and 38.3 g (0.4 mole) potassium acetate. The solution was heated to boiling and 0.4 mole acetic acid was added to the mixture over a 24-hour period. The solution was further diluted with water and treated with 44 g (0.2 mole) zinc acetate dihydrate resulting in the production of a white crystalline precipitate which was collected and washed with water. The precipitate was then slurried in water and treated with concentrated hydrochloric acid of approximately equal volume. After cooling, a white crystalline product was collected and dried. The solid was determined to be bis-(1(2)H-tetrazol-5-yl)-amine based on carbon 13 NMR spectroscopy and was recovered in a yield of ca. 70% based on dicyanamide.

EXAMPLE 6

An alternative preparation of bis-(1(2)H-tetrazol-5-yl)-amine is set forth herein. Sodium dicyanamide (72 g, 0.8 mole), sodium azide (114 g, 1.76 moles) and ammonium chloride (94 g, 1.76 moles) were dissolved in about 800 ml water and refluxed for 20 hours. To this was added a solution of 0.8 mole zinc acetate dihydrate in water to form a white precipitate. The precipitate was collected, washed with water, and treated with a solution of 200 ml water and 400 ml concentrated hydrochloric acid for one hour at room temperature. The solids were collected, washed again with water, and then digested with 100 ml water and 600 ml concentrated hydrochloric acid at 90° C. The mixture was allowed to cool, producing a mass of white crystals which were collected, washed with water, and dried in vacuo (1 mm Hg) at 150° F. for several hours. A total of 80 grams (65% yield) of solid bis-(1(2)H-tetrazol- 5-yl)-amine were collected as determined by carbon 13 NMR spectroscopy.

EXAMPLE 7

This example illustrates a process of preparing BTA-metal complexes. A BTA/Cu complex was produced using the following starting materials:

| | FW | MMol. | gm. |
|---|---|---|---|
| BTA | 153 | 6.54 | 1.0 |
| $Cu(NO_3)_2.2.5H_2O$ | 232.6 | 6.54 | 1.52 |

The $Cu(NO_3)_2.2.5H_2O$ was dissolved in 20 ml of distilled water. The BTA was dissolved in 60 ml distilled water with warming. The solutions were combined, and a green precipitate was immediately observed. The precipitate was dried and recovered.

EXAMPLE 8

This example illustrates a process of preparing BTA-metal complexes. A BTA/Zn complex was produced using the following starting materials:

| | FW | MMol. | gm. |
|---|---|---|---|
| BTA | 153 | 6.54 | 1.0 |
| $Zn(NO_3)_2.4H_2O$ | 261.44 | 6.54 | 1.71 |

The $Zn(NO_3)_2.4H_2O$ was dissolved in 20 ml of distilled water. The BTA was dissolved in 60 ml distilled water with warming. The solutions were combined, crystals were observed, and the material was collected and dried.

EXAMPLE 9

Gas generating compositions were prepared utilizing 5-aminotetrazole as fuel instead of BTA. Commercially obtained 5-aminotetrazol monohydrate was recrystallized from ethanol, dried in vacuo (1 mm Hg) at 170° F. for 48 hours and mechanically ground to a fine powder. Cuptic oxide (15.32 g, 76.6%) and 4.68 g (23.4%) of the dried 5-aminotetrazole were slurried in 14 grams of water and then dried in vacuo (1 mm Hg) at 150° F. to 170° F. until the moisture content was approximately 25% of the total generant weight. The resulting paste was forced through a 24 mesh screen to granulate the mixture, which was further dried to remove the remaining moisture. A portion of the resulting dried mixture was then exposed to 100% relative humidity at 170° F. for 24 hours during which time 3.73% by weight of the moisture was absorbed. The above preparation was repeated on a second batch of material and resulted in 3.81% moisture being retained.

Pellets of each of the compositions were pressed and tested for burning rate and density. Burning rates of 0.799 ips at 1,000 psi were obtained for the anhydrous composition, and burning rates of 0.395 ips at 1,000 psi were obtained for the hydrated compositions. Densities of 3.03 g/cc and 2.82 g/cc were obtained for the anhydrous and hydrated compositions respectively. Exposure of pellets prepared from the anhydrous condition to 45% and 60% Rh at 70° F. resulted in incomplete degradation of the pellets to powder within 24 hours.

EXAMPLE 10

Gas generant compositions were prepared according to the process of the present invention and their performance compared to gas generant compositions prepared by conventional means.

A gas generating composition within the scope of the invention was prepared and comprised a mixture of 22.8% BTA and 77.2% CuO. The BTA was in the monohydrated form and the overall composition comprised about 2.4% water by weight.

Six pellets of the material were prepared. The pellets were approximately 0.5 inches in diameter and 0.5 inches long. Two pellets served as controls (pellets 1 & 2). Two pellets were dried at 115° C. for more than 400 hours and placed in a sealed container (pellets 3 & 4). The remaining two pellets were dried at 115° C. for more than 400 hours in the open air (pellets 5 & 6).

The pellets were weighed to determine weight loss, and then ignited and their burn rates measured. The results are as follows:

| Pellet # | Burn Rate (ips @ 1000 psi) | % Weight Loss |
|---|---|---|
| 1 | 0.62 | — |
| 2 | 0.58 | — |
| 3 | 0.955 | 5.0 |
| 4 | 0.949 | 5.0 |
| 5 | 0.940 | 6.0 |
| 6 | 0.853 | 6.1 |

The difference in burn rate between the control and anhydrous samples is significant. It is also notable that there was no discernable difference between the burn rate of the sample stored in a sealed container and those exposed to air.

EXAMPLE 11

In this example, compositions similar to those tested in Example 10 were prepared and tested for burn rate. In the first set of tests, the compositions were prepared and dehydrated. Following dehydration, the compositions were pressed into pellets.

It was observed that these pellets were crumbly and difficult to handle. The average burn rate was approximately 1.1 ips at 1000 psi. The crush strength was from about 10 to about 26 pounds for unaged, and from about 20 to about 57 pounds for aged (115° C., 400 hours) samples. Exposure of these pellets to 45% and 60% Rh at 70° F. resulted in completed degradation to powder within 24 hours.

EXAMPLE 12

In this example the composition of Example 11 was made but the material was pressed in the hydrated form and then dried to the anhydrous form. A water weight loss of 5% to 6% was observed during drying. Pellets were formed from both the anhydrous material (press first and then dehydrated) and a hydrated control material. Some of the pellets were stored in sealed containers and some of the pellets were store in the open. Crush strength and burn rates were then measured and were as follows:

| Sample | Avg. Burn Rate (ips @ 1000 psi) | Avg. Crush Str. (lb. load) |
|---|---|---|
| Control | 0.61 | 70 |
| Anhydrous (sealed) | 0.96 | 60 |
| Anhydrous (open) | 1.25 | 35 |

EXAMPLE 13

In this example, further test pellets were formulated using BTA/CuO in the manner described above. In this example, some of the pellets were again pressed wet and then dried to the anhydrous state. A control was formulated which was pressed wet and not dried. A further sample was prepared in which the composition was pressed wet, dried, and rehumidified. Crush strengths and burn rates were then measured and the following data was obtained:

| Sample | Avg. Burn Rate (ips @ 1000 psi) | Avg. Crush Str. (lb. load) |
|---|---|---|
| Press wet | 0.56 ips | 66 |
| Press wet, dried | 1.14 | 43 |
| Press wet, dried rehumidified | cracked pellet | 40–55 |

It can be seen from this example, that the anhydrous material has an improved burn rate and can be processed if pressed wet and then dried.

EXAMPLE 14

In this example compositions within the scope of the invention were prepared. The compositions comprised 76.6% CuO and 23.4% 5-aminotetrazole. In one set of compositions, the 5-aminotetrazole was received as a coarse material. In the other set of compositions, the 5-aminotetrazole was recrystallized from ethanol and then ground.

A water slurry was prepared using both sets of compositions. The slurry comprised 40% by weight water and 60% by weight gas generating composition. The slurry was mixed until a homogenous mixture was achieved.

The slurry was dried in air to a stable weight and then pressed into pellets. Four pellets of each formulation were prepared and tested. Two pellets of each composition were dried at 110° C. for 18 hours and lost an average of 1.5% of their weight.

Burn rate was determined at 1,000 psi and the following results were achieved:

| Sample | Burn Rate (ips) (ips @ 1000 psi) | Density (gm/cc) |
|---|---|---|
| Coarse 5-AT/no post drying | 0.620 | 2.95 |
| Coarse 5-AT/post drying | 0.736 | 2.94 |
| Fine 5-AT/no post drying | 0.639 | 2.94 |
| Fine 5-AT/post drying | 0.690 | 2.93 |

Overall, improved results were observed using the post drying method of the present invention.

EXAMPLE 15

In this example, four 10 gram mixes of BTA/CuO gas generating composition were prepared utilizing 22.9% BTA, 77.1% CuO and 40 parts per hundred distilled water. In the first mix the pH of the distilled water was adjusted to approximately 1 by the addition of aqueous HCl. In the second mix the pH of the water was unadjusted and determined to be ca. 5.0. In the third mix, aqueous ammonia was added to adjust the pH to 8.0 and in the fourth mix aqueous ammonia was added to adjust the water pH to ca. 11.

In all four cases, the solids and water were thoroughly mixed to achieve a smooth paste which was subsequently allowed to dry in the open air for 72 hours. Two pellets of each composition were then prepared by pressing and further drying at 110° C. for 24 hours. Burning rate at 1000 psi and pellet density were determined. The results are as follows:

| Sample | Water pH | % Wt. loss at 110° C. | Burn Rate | Density (g/cc) |
|---|---|---|---|---|
| 1 | 1 | 3.1 | 0.92 | 2.78 |
| 2 | 5 | 3.3 | 1.35 | 3.02 |
| 3 | 8 | 3.3 | 1.35 | 3.01 |
| 4 | 11 | 4.1 | 1.45 | 2.88 |

The burning rate of the composition was influenced by the pH of the mix water. Further evidence of this influence is obtained by the observation that mixes 2, 3, and 4 were dark grey in color after processing and drying, whereas mix 1 was distinctly dark green, indicating a chemical change had occurred as a result of the conditions employed. Consequently, it may be seen that careful control of processing conditions is necessary to achieve specific desired high burn rates.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for preparing a gas generating composition comprising the steps of:

a) pressing a quantity of gas generating material into pellets, said gas generating material comprising an oxidizer and a hydrated fuel, said fuel selected from the group consisting of tetrazoles; and b) drying said pellets until the hydrated fuel is converted to anhydrous form.

2. A method for producing a gas generating composition as defined in claim 1 further comprising the step of protecting the gas generating material, including said anhydrous fuel, from exposure to water.

3. A method for producing a gas generating composition as defined in claim 1 wherein said tetrazole is selected from the group consisting of 5-aminotetrazol, a salt thereof, a complex thereof, and a mixture thereof.

4. A method for producing a gas generating composition as defined in claim 1 wherein said gas generating composition is selected from the group consisting of bis-(1(2)H-tetrazol-5-yl)amine, a salt thereof, a complex thereof, and a mixture thereof.

5. A method for producing a gas generating composition as defined in claim 1 wherein said oxidizer is selected from the group consisting of a metal oxide and a metal hydroxide.

6. A method for producing a gas generating composition as defined in claim 5 wherein said metal oxide or said metal hydroxide is a transition metal oxide or a transition metal hydroxide.

7. A method for producing a gas generating composition as defined in claim 1 wherein said oxidizer is an oxide or hydroxide of a metal selected from the group consisting of copper, molybdenum, bismuth, cobalt and iron.

8. A method for producing a gas generating composition as defined in claim 1 wherein said fuel is present in an amount ranging from about 10 to about 50 percent by weight, and said oxidizer is present in an amount ranging from about 90 percent to about 50 percent by weight.

9. A method for producing a gas generating composition as defined in claim 1 wherein said salt or complex of the tetrazole is a transition metal salt or complex thereof.

10. A method for producing a gas generating composition as defined in claim 1 wherein said tetrazole is a tetrazole salt or complex of a metal selected from the group consisting of iron, boron, copper, cobalt, zinc, potassium, sodium, strontium, and titanium.

11. A method for producing a gas generating composition as defined in claim 1 wherein said gas generating composition also includes a burn rate modifier.

12. A method for producing a gas generating composition as defined in claim 1 wherein said gas generating composition also includes a binder.

13. A method for producing a gas generating composition as defined in claim 1 wherein said gas generating composition also includes a slag forming agent.

14. A method for producing a gas generating composition comprising the steps of:

a) obtaining a quantity of gas generating material, said gas generating material comprising an oxidizer and a hydrated fuel, said fuel selected from the group consisting of tetrazoles;

b) preparing a slurry of said gas generating material in water;

c) drying said slurried material to a constant weight;

d) pressing said material into pellets while said fuel is in a hydrated form; and e) drying said pellets until the gas generating material is in anhydrous form.

15. A method for producing a gas generating composition as defined in claim 14 wherein said slurry comprises from about 3% to about 40% by weight water and from about 60% to about 97% by weight gas generating material.

16. A method for producing a gas generating composition as defined in claim 14 wherein the drying of the slurry in step (d) takes place at a temperature below approximately 110° F.

17. A method for producing a gas generating composition as defined in claim 14 wherein said tetrazole is selected from the group consisting of 5-aminotetrazol, a salt thereof, a complex thereof, and a mixture thereof.

18. A method for producing a gas generating composition as defined in claim 14 wherein said gas generating composition is selected from the group consisting of bis-(1(2)H-tetrazol-5-yl)amine, a salt thereof, a complex thereof, and a mixture thereof.

19. A method for producing a gas generating composition as defined in claim 14 wherein said oxidizer is selected from the group consisting of a metal oxide and a metal hydroxide.

20. A method for producing a gas generating composition as defined in claim 19 wherein said metal oxide or said metal hydroxide is a transition metal oxide or a transition metal hydroxide.

21. A method for producing a gas generating composition as defined in claim 14 wherein said oxidizer is an oxide or hydroxide of a metal selected from the group consisting of copper, molybdenum, bismuth, cobalt and iron.

22. A method for producing a gas generating composition as defined in claim 14 wherein said fuel is present in an amount ranging from about 10 to about 50 percent by weight, and said oxidizer is present in an amount ranging from about 90 percent to about 50 percent by weight.

* * * * *